United States Patent [19]

Klinkel

[11] Patent Number: 4,965,986

[45] Date of Patent: Oct. 30, 1990

[54] APPARATUS FOR FORMING, FILLING AND SEALING BAG-TYPE PACKAGES

[76] Inventor: Wolfgang Klinkel, Sala Capriasca, 6954, Bigorio, Switzerland

[21] Appl. No.: 363,964

[22] Filed: Jun. 9, 1989

[30] Foreign Application Priority Data

Jul. 15, 1988 [CH] Switzerland ..... 02714/88

[51] Int. Cl.[5] ..... B65B 9/08; B65B 41/16

[52] U.S. Cl. ..... 53/551; 53/389

[58] Field of Search ..... 53/373, 389, 436, 451, 53/526, 527, 551, 552

[56] References Cited

U.S. PATENT DOCUMENTS

| | | | |
|---|---|---|---|
| 2,676,444 | 4/1954 | Gaubert | 53/373 |
| 3,027,695 | 4/1962 | Leasure | 53/451 |
| 3,530,642 | 9/1970 | Leimert | 53/373 |
| 4,291,520 | 9/1981 | Prince et al. | 53/373 X |
| 4,292,786 | 10/1981 | Long et al. | 53/527 X |
| 4,532,753 | 8/1985 | Kovacs | 53/552 X |
| 4,563,862 | 1/1986 | McElvy | 53/552 |
| 4,566,253 | 1/1986 | Jones | 53/551 X |
| 4,691,499 | 9/1987 | Umeda et al. | 53/389 X |
| 4,727,707 | 3/1988 | Hadden | 53/552 X |
| 4,800,707 | 1/1989 | Rabus | 53/552 |

FOREIGN PATENT DOCUMENTS

| | | |
|---|---|---|
| 1271615 | 6/1968 | Fed. Rep. of Germany . |
| 1511837 | 8/1969 | Fed. Rep. of Germany . |

*Primary Examiner*—Robert L. Spruill
*Assistant Examiner*—Linda B. Johnson
*Attorney, Agent, or Firm*—Werner W. Kleeman

[57] ABSTRACT

The invention relates to an apparatus for forming, filling and sealing bag-type packages. For certain filling products it is advantageous to "strip" or flatten the bag-type package prior to sealing, i.e. to ensure that the bag is volumetrically displaced. As a result all bag-type packages are tightly filled despite varying specific weight of the filling product. This object of the invention is achieved by return conveyance or feed of the bag hose or tube and passage of the latter through a constrictive location. An advantage of the apparatus resides in the possibility of achieving high production speeds by virtue of small moved masses.

12 Claims, 7 Drawing Sheets

FIG. 3A.
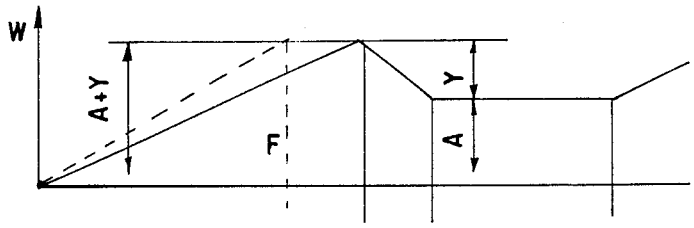
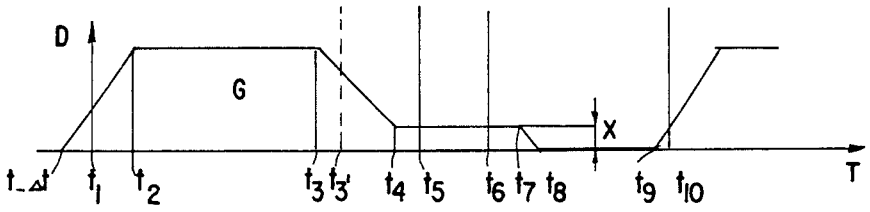
FIG. 3B.

FIG 4a
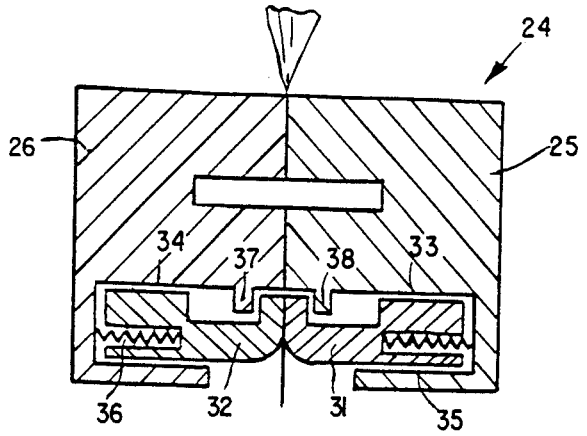
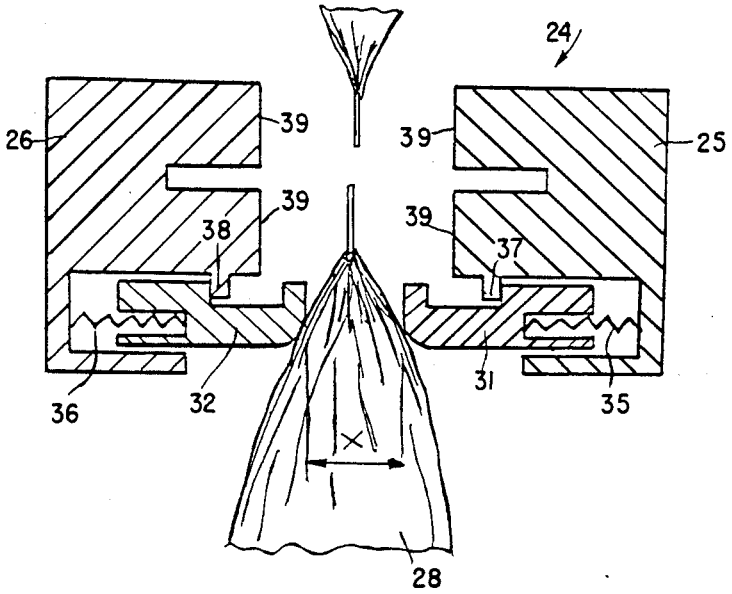
FIG 4b

FIG. 6.
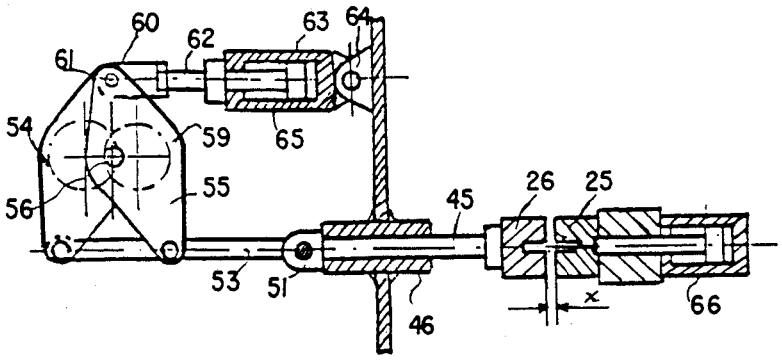
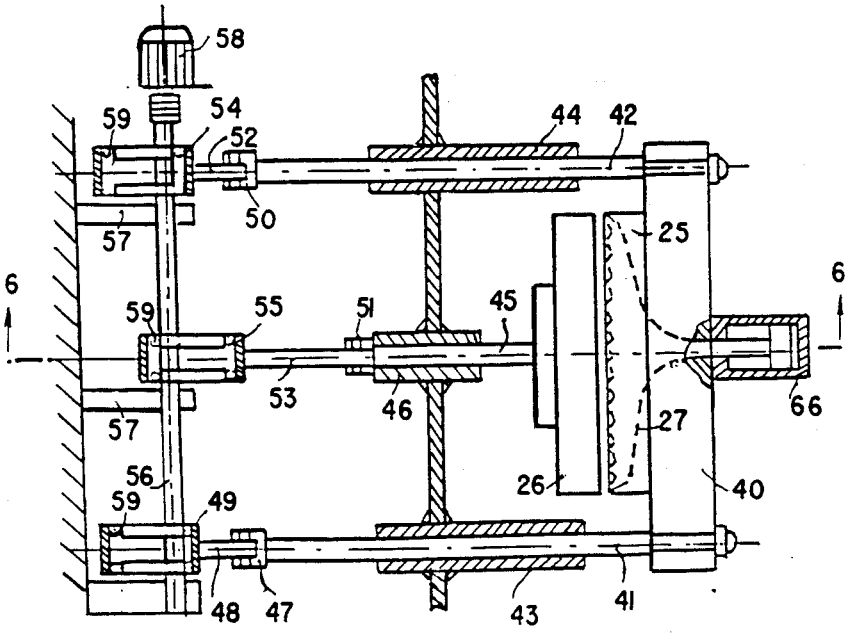
FIG. 5.

APPARATUS FOR FORMING, FILLING AND SEALING BAG-TYPE PACKAGES

BACKGROUND OF THE INVENTION

The present invention broadly relates to apparatus or machines for the manufacture of sealingly filled bags and, more specifically, pertains to a new and improved construction of an apparatus for forming, filling and sealing bag-type packages.

Generally speaking, the new and improved construction of an apparatus for forming, filling and sealing bag-type packages is of the type comprising means for infeeding a foil web from a supply roll or roller, a feed pipe or conduit for infeeding the product or material to be packed in the bag-type packages to be formed and sealed, and a formed or shaped shoulder arranged at the top or upper end of the feed pipe, the foil web being drawn over the formed or shaped shoulder in order to coil the foil web and form a foil hose or tube. Furthermore, the apparatus is provided with longitudinal sealing means for sealing the foil hose or tube in the lengthwise direction, hose conveying means for conveying the foil hose or tube along the feed pipe, and transverse sealing means for sealing the foil hose or tube at predetermined package distances and in a transverse direction relative to the lengthwise direction thereof. The transverse sealing means comprise a sealing mechanism with sealing elements operating in two stages. The transverse sealing means also are provided with stripping means which are located downstream of the sealing elements. Such stripping means are yieldable or resiliently biasable with respect to the sealing elements such that, during the first stage of operation of the sealing elements of the sealing mechanism to form the transversely disposed constrictive location in the hose, the stripping means move first up to the predetermined gap width while the sealing elements are located at a larger mutual spacing.

An apparatus of the above type is disclosed, for example, in German Patent No. 3,031,399, published Mar. 19, 1981.

This prior art apparatus comprises a feed pipe for filling or pouring in the product to be packed in packages to be fabricated of a web of flexible packing material, and a formed or shaped shoulder located at the upper end of the feed pipe. The web is drawn over the formed or shaped shoulder in order to form the web into a hose or tube. This apparatus also comprises a web forward-feed device which draws off the web from a supply or stock and conveys the same to the formed or shaped shoulder, and a hose forward-feed device arranged at the feed pipe in order to provide forward or downstream travel of the hose or tube along the feed pipe. Finally, the known apparatus comprises a transverse sealing device which is provided downstream of the feed pipe for sealing the hose or tube in package-length intervals determined by the hose forward feed. The hose forward-feed device contains a drive having a slip mechanism or device, such drive allowing for conveyance of the web in only one direction, namely in the feed or downstream direction.

It is further known, for example, from Swiss Patent No. 656,362, published June 30, 1986, to operate with so-called register or index markings, i.e. markings placed upon the web foil in adequate evenly spaced distances. Such pre-printed markings correspond with a predetermined bag or sack length and normally serve to automatically control the web forward feed of the bag forming, filling and sealing machine.

Known apparatuses or machines for fabricating bag-type packages do render possible the manufacture of bags or sacks or the like of substantially uniform length, without however taking into consideration the varying qualities and characteristics of the filling material or product.

Therefore, it can occur that the filling weight of the product or material actually remains substantially constant, this normally being the fixed parameter as required by law for the filling operation, while the volume of the product or material can substantially fluctuate or vary for a great number of reasons.

Since the bag-type package length is given by the markings on the foil web, a varying and undesired degree of filling of the bag-type package is the result of the fluctuating product volume. In order not to produce half-empty packages, also known as fraudulent or untrue weight packages, it is absolutely necessary to select the product filling quantity as a function of the smallest occurring product filling volume for the respective filling product or material. A larger product filling volume would mean that less space in the bag is available for the product, such that serious difficulties arise during the sealing operation for the bag or sack. The filling material, particularly highly voluminous and highly elastic products such as, for example, potato chips, has the tendency to expand in the region or zone of the predetermined sealing seam, so that the sealing operation, whether by sealing, welding or by any other suitable method, is rendered more difficult or even impossible.

An attempt was made to solve this problem associated with the same type of vertical bag forming, filling and sealing machines as the present development in that a so-called "stripping flat" or flattening of the package end is accomplished after filling the bag or sack with filling material but prior to carrying out the sealing operation resulting in the formation of the upper transverse seam.

A machine for accomplishing the operation of stripping or stripping-flat is shown, for example, in German Published Patent Application No. 3,046,710, published Sept. 10, 1981. This prior art machine is provided with an apparatus for stripping-flat and sealing the package end. This apparatus includes a frame, a front sealing jaw and a rear sealing jaw, the jaws being displaceable in a generally horizontal direction between an open and a closed position, whereby an actuating element is provided at the frame for moving the sealing jaws between the open and the closed positions as well as a partially open position, in which the sealing jaws approach each other but are still not completely closed in a manner suitable for sealing a package. In this partially open position, stripping elements are arranged at the sealing jaws and movable with the latter in order to grasp from opposite sides the hose or tube of packing material and nearly completely close the hose or tube, while the sealing jaws are in their intermediate position. In this intermediate position, means are connected to the frame, such means being suitable to move the frame together with the actuating element, the sealing jaws and the stripping elements, the latter being in their intermediate position. These aforesaid means are suited to effect a generally vertical and downwardly directed movement of the sealing jaws and the stripping elements relative to the hose or tube formed of packing material. In this manner, the hose or tube is internally cleared and flattened for the actual sealing operation to be accomplished by the sealing jaws which are subsequently in their completely closed position.

This known apparatus does solve the aforementioned problems of bag forming, filling and sealing apparatus of the type of the present development, but still has the disadvantage in that the entire mechanism of the transverse sealing device must be moved up and down in the vertical direction and at the high pace of bag fabrication. Due to the fact that the transverse sealing device normally possesses a relatively great mass, very high forces occur during the aforementioned up-and-down motion. Such forces must be overcome and are, in any case, detrimental with regard to the mode of operation of the machine. As a result, the maximum possible production of a bag forming, filling and sealing machine equipped with this apparatus for stripping-flat and sealing the hose forming the bags is limited by the occurring high forces.

SUMMARY OF THE INVENTION

Therefore with the foregoing in mind it is a primary object of the present invention to provide a new and improved construction of an apparatus for forming, filling and sealing bag-type packages and which apparatus does not suffer from the aforementioned drawbacks and shortcomings of the prior art constructions.

Another important and more specific object of the present invention not only aims at avoiding the aforenoted drawbacks of the prior art constructions but, in particular, seeks to achieve reliable operation in the production of tightly filled and stripped-flat bags, without having to move up-and-down larger masses such as those of the transverse sealing device or mechanism or of the feed pipe with the formed or shaped shoulder arranged thereat.

Yet a further noteworthy object of the present invention is directed to a new and improved construction of an apparatus for forming, filling and sealing bag-type packages and which is relatively simple in construction and design, extremely reliable in operation, relatively economical to manufacture, not readily subject to breakdown and malfunction, and requires a minimum of maintenance and servicing.

Now in order to implement these and still further objects of the present invention which will become more readily apparent as the description proceeds, the apparatus of the present invention is manifested, among other things, by the features that the means for infeeding the foil web have drivable web entrainment means acting upon the foil web and arranged upstream of the formed or shaped shoulder, such drivable web entrainment means being provided with drive means for at least return motion or travel of the foil web in a predetermined longitudinal return travel direction. The hose conveying means comprise drivable hose entrainment means acting upon the hose or tube, such drivable hose entrainment means being provided with reversible drive means for motion or travel of the hose or tube in the predetermined longitudinal downstream travel direction and the predetermined longitudinal return travel direction. During the motion or travel of the hose or tube in the predetermined longitudinal return travel direction, the hose or tube is stripped or flattened by the stripping means and kept at a distance from the sealing elements of the sealing mechanism.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIGS. 3A and 3B show diagrams respectively illustrating the course or cycle of the motions or movements of the foil web and the foil hose or tube as well as of the transverse sealing mechanism constructed according to the invention, the diagram showing the chronological sequence of the operations;

FIG. 4*a* shows a simplified illustration of the transverse sealing mechanism in the closed condition i.e. during the sealing or welding operation;

FIG. 4*b* shows a simplified illustration of the transverse sealing mechanism in the half-open condition during the inventive return conveyance or feed of the foil hose or tube;

FIG. 5 shows a top plan view of a suitable mechanism for the drive of the transverse sealing device; and FIG. 6 shows a section through the mechanism in FIG. 5 taken substantially along the line 6—6 thereof.

DETAILED DESCRIPTION OF THE PREFERRED EMBODIMENTS

Figure 1:
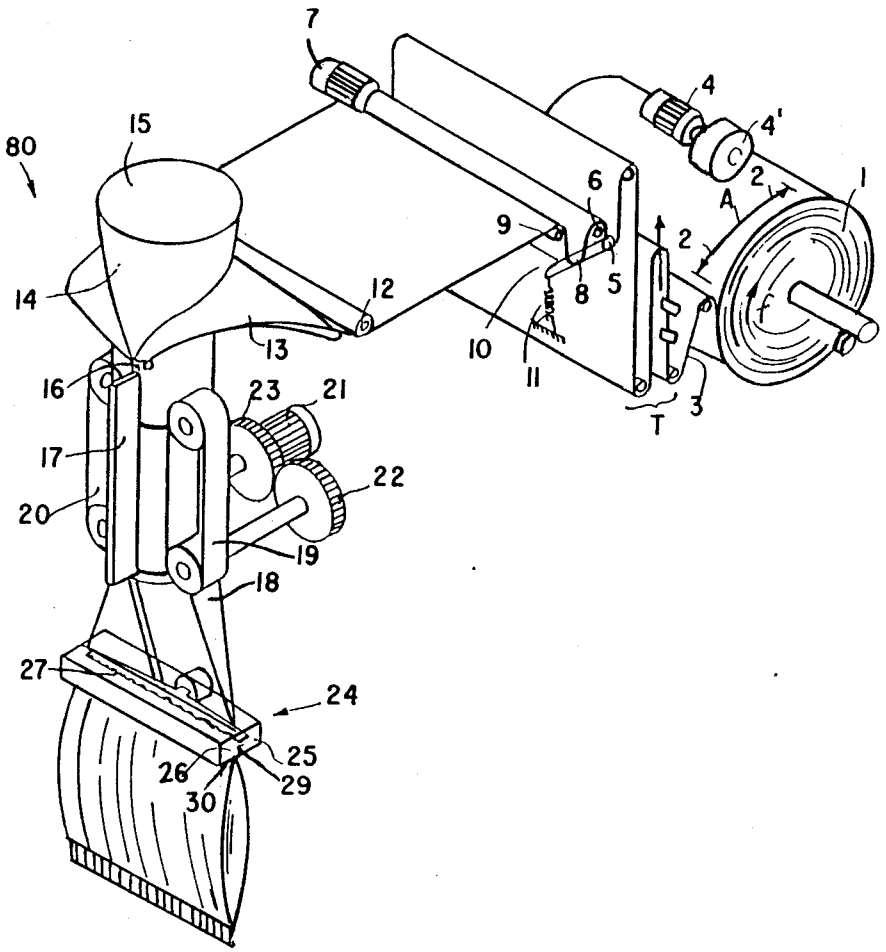
FIG. 1 shows a general view of the bag forming, filling and sealing machine constructed according to the invention and shown in a schematic and axonometric illustration.

Describing now the drawings, it is to be understood that to simplify the showing thereof, only enough of the structure of the apparatus for forming, filling and sealing bag-type packages has been illustrated therein as is needed to enable one skilled in the art to readily understand the underlying principles and concepts of this invention. Turning now specifically to FIG. 1 of the drawings, a schematically depicted apparatus 80 for forming, filling and sealing bag-type packages illustrated therein by way of example and not limitation comprises a roll or coil 1 of any suitable packing foil 3 which is usually printed and bears markings 2 particularly at the foil edge or edges, such markings 2 being used for the control operations of the apparatus or machine 80 as will be described hereinafter. All elements not specifically relevant for understanding the present invention and particularly the frame of the apparatus or machine 80 have not been depicted to facilitate the illustration and improve clarity thereof.

The roll or coil 1 of packing foil 3 is driven, when required, in a predetermined direction of conveyance or forward feed by a drive motor 4 which drives a friction wheel or roll 4' which is pressed against the surface of the roll or coil 1. By the arrow f there is indicated the direction of rotation of the roll or coil 1 in accordance with the direction of conveyance of the packing foil 3. This packing foil 3 is then driven over a roll or roller combination known as a dancing or compensating roll or roller combination or structure T, the function of such roll or roller combination or structure being the compensation or balance between the foil requirement of downstream located work or operating elements and the supply roll or coil 1. This dancing or compensating roll or roller combination T thus renders possible in known manner that the conveying motions or movements in the region or zone of the work or operating elements described in greater detail hereinafter are independent of the inertia of the large and heavy roll or coil 1, such conveying motions or movements having to be effected relatively rapidly and accurately. The dancing or compensating roll or roller combination T can particularly, but must not necessarily within the scope of the present invention, serve to subsequently deliver foil material when the foil material reserve in the dancing or compensating roll or roller combination T is depleted. In such an event, the drive motor 4 is activated for a predetermined amount of web feed or conveyance in the direction f when the rolls or rollers of the dancing or compensating roll or roller combination T fall short of certain limits of foil material reserve.

After passing the dancing or compensating roll or roller combination T, the packing foil 3 reaches a pair of rolls or rollers 5 and 6, such a pair consisting of two rolls or rollers forming a so-called clamping nip or line. These rolls or rollers 5 and 6 are pressed together by any suitable pressing or biasing means not particularly shown in the drawing and the packing foil 3 is guided through the clamping nip or line of the pair of rolls or rollers 5 and 6, i.e. through the tangent or contact line of both rolls or rollers 5 and 6. The roll or roller 6 is rotatingly driven by a suitable drive motor 7, the characteristics and functions of which will be hereinafter disclosed in greater detail. For reasons which will become more apparent as the description proceeds, there are advantageously selected according to the invention, a low-inertia drive motor 7 as well as low-inertia rolls or rollers 5 and 6.

However, at this stage it should be understood that the pair of rolls or rollers 5 and 6 has the function of controlling the movements of the packing foil 3 between the dancing or compensating roll or roller combination T and the actual work or operating elements of the apparatus 80 and, in particular, of insuring that the web of packing foil 3 is always uniformly tensioned and conveyed without forming folds or pleats.

Deflection rolls or rollers 8 and 9 arranged downstream of the pair of rolls or rollers 5 and 6 correspond with an advantageous known roll or roller arrangement for achieving a substantially tension-controlled feed or infeed of the packing foil 3 to the work or operating elements. The roll 9 is stationarily mounted while the roll 8 can be readily moved between the stationary rolls 6 and 9 by means of two tension levers or lever members 10 and a spring 11. Only one of the two tension levers or lever members 10 is visible in FIG. 1.

The aforesaid guide or feed elements for the packing foil 3 represent only one example of a possible packing-foil feed device which can be used within the teachings of scope the present invention. However, other suitable constructions are readily conceivable in accordance with the teachings of the present invention because, within the scope of the present invention, it is solely required that the packing foil 3 can be guided to the work or operating elements of the apparatus 80 by means of a nip or clamping location formed by the pair of rolls or rollers 5 and 6, the guidance being controllable in length and being of low inertia.

The expansively held or supported and suitably tensioned web of the packing foil 3 is conveyed to a so-called formed or shaped shoulder 13 via a deflection roll or roller 12. This formed or shaped shoulder 13 or equivalent structure, also known as a roll-in body, has the function of rolling or wrapping the flat packing foil 3 around a feed or guide pipe 14 in such a manner that a spatially closed hose or tube 18 is formed around the feed or guide pipe 14. The feed or guide pipe 14 is usually referred to as a filling pipe because the filling material or product is filled through such filling pipe into a bag or sack to be formed. For this purpose, the feed or guide pipe 14 comprises in the upper part or portion thereof a substantially funnel-shaped opening 15 through which, at very specific or predetermined filling phases or stages, constant quantities of filling material or product are introduced into the feed or guide pipe 14 by means of suitable dosing devices not particularly shown in the drawings.

Immediately downstream of the formed or shaped shoulder 13 the hose or tube 18 possesses an open longitudinal seam 16 by means of which the packing foil material 3 is slightly overlapping but not yet joined or closed. In order to seal or close the longitudinal seam 16, so called because it extends in the lengthwise direction of the hose or tube 18, there is provided a longitudinal sealing device 17 which is only schematically depicted in FIG. 1 as a substantially perpendicular box equipped with suitable heating elements which are not particularly shown in the drawings. Such longitudinal sealing device 17 is known to the art and thus does not have to be here further discussed with respect to the construction and function thereof. Nevertheless, it should be mentioned that it is relatively irrelevant whether the longitudinal sealing device 17 operates as a sealing or welding apparatus or functions according to any other suitable closing method.

In order to accurately convey or feed the packing foil 3 which has now become the closed hose or tube 18, there is provided a pair of draw-off belts or bands 19 and 20 such as disclosed, for example, in the aforesaid German Patent No. 3,031,399. These two draw-off belts or bands 19 and 20 are laterally arranged with respect to the feed or guide pipe 14, and preferably substantially symmetrically disposed relative to the longitudinal sealing device 17.

The draw-off belts or bands 19 and 20 convey or feed the hose or tube 18 by clamping the latter between the surface of the feed or guide pipe 14 and respective inner runs or strands of the two draw-off belts or bands 19 and 20.

Both draw-off belts or bands 19 and 20 are mutually driven by a drive motor 21 and suitable transmission means, for example, gear wheels 22 and 23. It is a characteristic feature of the present invention that the drive motor 21 is reversible, i.e. the draw-off belts or bands 19 and 20 can be driven in both possible directions. When such draw-off belts or bands 19 and 20 are driven in the so-called "normal" direction of conveyance, i.e. in the downstream travel direction, the draw-off belts or bands 19 and 20 convey the hose or tube 18 along the feed or guide pipe 14 in the downward direction relative to the showing in FIG. 1, while in the case of return or reverse conveyance of the hose or tube 18, the latter is upwardly displaced relative to the showing in FIG. 1.

Downstream of the pair of draw-off belts or bands 19 and 20, as viewed in the so-called "normal" direction of conveyance, there is provided a transverse sealing device 24 which comprises two sealing jaws 25 and 26 and usually also contains a knife 27 or the like for separating the individual bags or sacks after fabrication thereof. The construction of the transverse sealing device 24 is basically known to the art. It advantageously comprises a two-stage sealing mechanism acting in two clearly defined stages. By virtue of this sealing mechanism which is not particularly shown in FIG. 1 but clearly depicted by way of example in FIG. 5, the transverse sealing device 24 can be completely closed to form a transverse seam, such closed condition being shown in FIG. 1, or actuated to form a transversely disposed constrictive location in the hose or tube 18, which constrictive location narrows up to a predetermined gap width. An essential characteristic of the present invention can be seen in the possibility of determining the degree of opening of the transverse sealing device or mechanism 24. This will become more apparent in the course of the following description of the mode of operation of the apparatus 80 constructed according to the invention.

Having now had the benefit of the foregoing discussion of the exemplary embodiment of the apparatus constructed according to the invention, the operational sequence of such apparatus is hereinafter described with respect to FIGS. *2a* through *2f* in which the apparatus 80 for forming, filling and sealing bag-type packages is shown in a simplified illustration thereof.

In FIG. *2a* there is depicted the condition in which a fabricated bag or sack has just been separated by the knife or cutter 27 which coacts with the clamping jaw 25 but is not visible in FIG. *2a*. Above the transverse sealing device 24, filling material already has been introduced through the feed or guide pipe 14 into the hose or tube 18 which is closed at the lower end thereof. Simultaneously with the filling of the new or next bag or sack and with the separation or severance of the preceding fabricated bag or sack, the following two operations are accomplished:

The transverse sealing device 24 is opened, i.e. the two sealing jaws or jaw members 25 and 26 start to separate. This movement is indicated by the arrows m in FIG. 2. The hose or tube 18, in which filling material is already present, is thus released in its lower or bottom part. Simultaneously thereto, whereby "simultaneous" can also include a slight chronological delay in the operational sequence, the draw-off belts or bands 19 and 20 are actuated by the drive motor 21 to revolve in the "normal" or downstream direction of conveyance of the hose or tube 18 as indicated by the arrows n. The downward motion or travel of the hose or tube 18 thus commences.

At this stage, it should be mentioned that the three aforementioned operations, namely filling the filling material or product through the feed or guide pipe 14, opening the transverse sealing device 24 and conveying the hose or tube 18 by the draw-off belts or bands 19 and 20, can sustain a certain sequentially staggered work cycle within the teachings of the present invention. It is thus readily conceivable, for example, that the filling material or product is delivered through the feed or guide pipe 14 and fed into the new or next bag or sack only after this bag or sack has moved downwards in the direction of the arrows n. However, according to the invention, it is essential that the travel of the sealing jaws 25 and 26 and of the draw-off belts or bands 19 and 20 can be controlled and mutually adjustably carried out. This can be accomplished by using accurately controllable drive systems, such as step or stepping motors or servo-motors and corresponding control units. This will be hereinafter described in conjunction with exemplary embodiments of such drive and control systems.

In FIG. *2b* there is shown an operational phase or stage in which the sealing jaws 25 and 26 of the transverse sealing device or mechanism 24 have reached the maximum mutual spacing or distance therebetween and are therefore stationary in this position. This can be derived from FIG. *2b* in that arrows m are no longer shown in the drawing. In this position it is essential that the largest possible width of the bag or sack can freely pass through the open sealing jaws 25 and 26. The arrows n indicate that the downward conveying movement of the hose or tube 18 is further carried out by the drive motor 21.

FIG. *2c* illustrates a further phase or stage of the inventive operational sequence. The downward travel of the hose or tube 18 continues in the "normal" or downstream direction of conveyance as indicated by the arrows n, while the sealing jaws 25 and 26, after having let by an adequate length of the new or next bag or sack, already commence a closing motion or movement as indicated by the arrows o. This operational stage simply shows that, in accordance with the invention, the movements of the draw-off belts or bands 19 and 20 and the movements of the sealing jaws 25 and 26 of the transverse sealing device 24 can be strictly adapted to one another, such that two advantages can be achieved:

a. The filling conditions of the bags or sacks can be optimumly accomplished as required by the objects of the invention and as will be hereinafter described in greater detail, and b. Time can be saved, since the motions or movements can be simultaneously effected such that no unnecessary waiting time is reserved for individual working or operating elements. In this manner, the production rate of the inventive bag forming, filling and sealing apparatus 80 is substantially increased.

However, it should be emphasized that the operational stage depicted in FIG. *2c* is not essential with respect to the present invention which likewise can be realized when the closing of the sealing jaws 25 and 26 is delayed until the downstream travel of the hose or tube 18 in the direction of the arrows n stops. Naturally, a time interval is lost in the predetermined operational sequence.

FIG. *2d* shows the most important phase or stage of the operation of the inventive bag forming, filling and sealing apparatus 80, which phase refers to the operation of "stripping" or "stripping flat" or flattening the bag or sack to be sealingly closed. The hose or tube 18 depicted in FIG. *2d* has already reached the lowest point of the downward travel thereof in the "normal" or downstream direction of conveyance. The position of the marking 2' in FIG. *2d* should be noted, such marking 2' being below or downstream of the transverse sealing device or mechanism 24. In accordance with the absence of arrows o in FIG. *2d*, the sealing jaws 25 and 26 of the transverse sealing device or mechanism 24 are standing still in a predetermined spaced relationship having a spacing or distance x, by virtue of which the hose or tube 18, but no longer the filling material or product, can still pass without hindrance between the sealing jaws 25 and 26. At this stage, the direction of rotation of the drive motor 21 is reversed, such that the hose or tube 18 is conveyed back or retracted by the draw-off belts or bands 19 and 20 in the return or "upward" direction. This hose upward travel is indicated by the arrows p in FIG. *2d*.

This return or reverse travel of the hose or tube 18 through the sealing jaws 25 and 26 closed up to the remaining gap width x accomplishes the inventive stripping or flattening of the hose or tube 18 now formed as a bag or sack 28 located below the transverse sealing device or mechanism 24. The gap width x is thereby selected such that the hose or tube 18 can slide through without hindrance, i.e. without any substantial braking effect, between the sealing jaws 25 and 26. On the other hand, the filling material or product is totally hindered from ascending and settling between the sealing jaws 25 and 26 where it could interfere with the sealing operation.

According to the invention, the gap width x is selected between 0.5 mm and 10 mm, whereby a gap width x between 2 mm and 4 mm has proven to be particularly advantageous. As depicted in FIG. *2d*, it is apparent that the travel of the hose or tube 18 in the "normal" or downstream direction of conveyance is effected over a greater length "A+y" than the desired or predetermined bag length A which is the distance or spacing between two consecutive markings 2, also shown in FIG. 1. It is also apparent that subsequently in the operational phases depicted in FIGS. *2d* and *2e* the conveyed excess hose length y is conveyed back in the return or "upward" direction of conveyance, hose stripping or stripping-flat being realized without any vertical motion or travel of the transverse sealing device 24 or of the feed or guide pipe 14 with the formed or shaped shoulder arranged thereat i.e. without any mass motion of operating elements.

Furthermore, the comparison between FIGS. *2d* and *2e* illustrates the relevance of the distance or spacing y. In FIG. *2d*, the marking 2' is located below or downstream of the transverse sealing device or mechanism 24. In FIG. *2e*, in which the return or reverse travel of the hose or tube 18 and the bag or sack 28 is terminated, the marking 2' has just arrived between the sealing jaws 25 and 26 because the transverse sealing seam should coincide with the marking 2'. Therefore, the distance or spacing y is the length of the path or travel of the marking 2' between the position thereof depicted in FIG. *2d* and the position thereof depicted in FIG. *2e*. This operation is indicated in FIG. *2e* in that the position of the marking 2' (FIG. *2d*) is shown in broken lines and designated with the reference numeral 2''. Experience has shown that this length y is advantageously determined between 1% and 20% of the length of the bag or sack 28.

In FIG. *2e*, as already mentioned hereinbefore, the return or reverse travel of the hose or tube 18 and of the bag or sack 28 is already terminated, this being indirectly indicated by the absence of arrows p, while the sealing jaws 25 and 26 of the transverse sealing device or mechanism 24 are still in spaced relationship defined by the spacing or distance x. This condition prevails only for a short instance, because the moment the return or reverse travel of the bag or sack 28 stops, the sealing jaws 25 and 26 are immediately fully closed, whereby the bag or sack 28 is closed by sealing, welding or any other suitable closing technique and then separated by the knife 27. This condition is illustrated in FIG. *2f*, in which there is also shown that, immediately after closing or forming the transverse seam, the filling material or product is introduced through the feed or guide pipe 14. In this manner, a full cycle for the fabrication of a "stripped" or flattened bag or sack 28 is terminated and the next following cycle can begin with the first operation depicted in FIG. *2a*.

In the interest of a high production rate of the bag forming, filling and seaming apparatus 80, it is preferable that the different movements of the hose or tube 18 and of the transverse sealing device or mechanism 24 are carried out substantially without loss of time or delay and, wherever possible, simultaneously accomplished.

In order to avoid the formation of folds and pleats in the packing foil 3 between the feed or guide pipe 14 and the dancing or compensating roll or roller combination T during the return or reverse travel of the packing foil 3 with the hose or tube 18 and the bag or sack 28, it is obviously necessary that the drive motor 7 is simultaneously reversed with the drive motor 21. It is possibly advantageous to ensure that the drive motor 7 takes over slightly more packing foil 3 than the drive motor 21 conveys back packing foil 3. In this manner, the packing foil 3 always remains tensioned even during the aforesaid return or reverse travel. On the other hand, it is not necessary that the drive motor 7 is actuated during the infeed of the packing foil 3 in the "normal" or downstream direction of conveyance, provided that the tension exerted by the draw-off belts or bands 19 and 20 is sufficient to ensure a positive and effective conveyance or infeed of the packing foil 3, and adequate such that the thereby produced tensioning of the packing foil 3 is not unduly high for the latter. The drive motor 7 is thus preferably also a pulse-controllable stepping motor which is possibly actuatable only for the return or reverse travel of the packing foil 3, so that the drive motor 7 is entrained in the "normal" or downstream direction of conveyance by the packing foil 3.

The chronological sequence of the movements of the hose or tube 18 and of the transverse sealing device or mechanism 24 are respectively illustrated in FIGS. 3A and 3B. The curve in FIG. 3A refers to the conveying motion or travel of the hose or tube 18, while the curve G in FIG. 3B represents the movements of the transverse sealing device or mechanism 24.

The time T is plotted on the mutual abscissa of both curves F and G in FIGS. 3A and 3B. In the case of the curve F in FIG. 3A, the ordinate shows the path or travel W covered by the hose or tube 18 or the packing foil 3, respectively, while in the case of the curve G in FIG. 3B, the ordinate shows the mutual distance or spacing D between the sealing jaws 25 and 26 of the transverse sealing device 24.

The curve F in FIG. 3A shows that the hose or tube 18, at the moment of time $t_1$ and after previous separation of the fabricated bag or sack 28, is set in motion in the "normal" or downstream direction of conveyance. This corresponds with the beginning of a cycle of bag or sack fabrication and with the condition depicted in FIG. *2f*. This forward or downstream motion or travel continues up to the moment of time $t_5$, and the hose or tube 18 is moved during this time interval by a travel length A+y in the "normal" or downstream direction of conveyance. At this moment of time $t_5$, which corresponds with the condition depicted in FIG. *2d*, the reversing of the motion or travel of the hose or tube 18 is accomplished, i.e. from the point of time $t_5$ the hose or tube 18 is conveyed in the return or reverse direction of conveyance.

This return or reverse conveyance continues up to the moment of time $t_6$ at which the hose or tube 18 has been conveyed back by the length or distance y, so that the total hose length conveyed in the "normal" or downstream direction of conveyance between the moment of time $t_1$ and the moment of time $t_6$ is equal to the desired or predetermined bag or sack length A. The hose or tube 18 then remains stationary up to the moment of time $t_{10}$ for the sealing operation and the separating operation. At this moment of time $t_{10}$ a new cycle commences, whereby the whole hose or tube 18 has been displaced by the bag length A relative to the moment of time $t_1$.

Figure 2B:
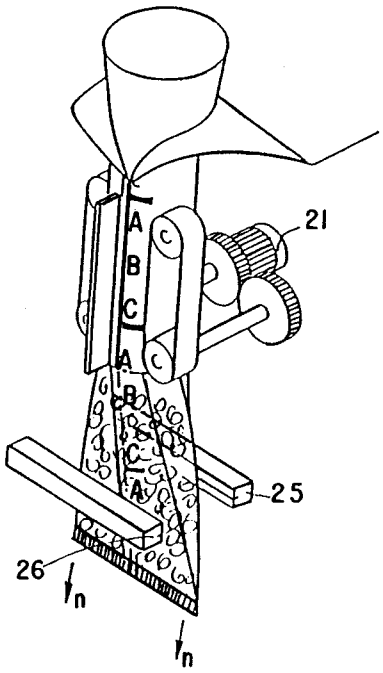
FIGS. 2*a* through 2*f* show simplified illustrations of the filling and sealing elements of the machine or apparatus constructed according to the invention and shown in different operational phases or stages in order to depict the inventive sequential course of the operations.
Figure 2A:
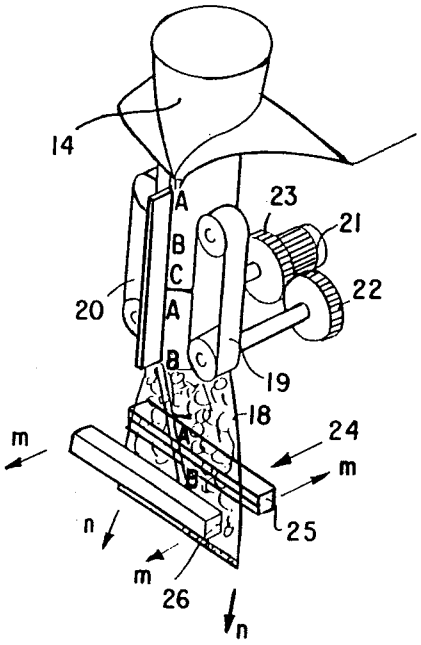
Figure 2D:
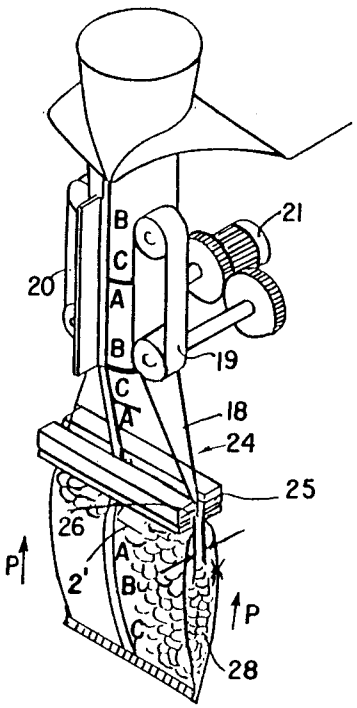
Figure 2C:
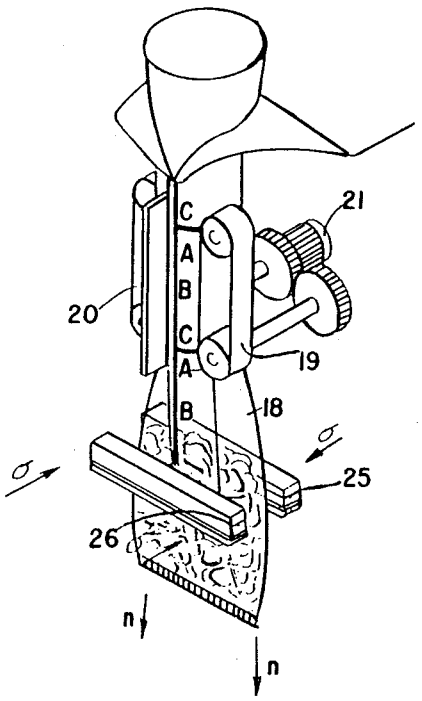

The curve G in FIG. 3B shows that already prior to the moment of time $t_1$, i.e. at the point of time $t_1-\Delta t$), the sealing jaws 25 and 26 have started their opening motion or travel. At the moment of time $t_1$, the sealing jaws 25 and 26 are already open, i.e. they have released the hose or tube 18 for conveyance in the "normal" or downstream direction of conveyance. This opening motion or travel of the sealing jaws 25 and 26 continues up to the moment of time $t_2$ which represents the condition shown in FIG. 2*b*. Between the moments of time $t_2$ and $t_3$ the sealing jaws 25 and 26 remain stationary in their maximum open position as depicted in FIG. 2*b*. At the moment of time $t_3$ and up to the moment of time $t_4$ the sealing jaws 24 and 25 slowly close until they have attained the mutual spacing x at the moment of time $t_4$, such mutual spacing x being the gap width for stripping or stripping-flat the bag or sack 28. This condition corresponds with the condition shown in FIG. 2*d*. The sealing jaws 25 and 26 now remain in this position up to the moment of time $t_7$. During a time interval between $t_4$ and $t_7$ and more so during the time interval $t_5$ to $t_6$, the hose or tube 18 is conveyed back and stripped flat. At the moment of time $t_7$, which represents the condition depicted in FIG. 2*e*, the closing movement of the sealing jaws 25 and 26 commences and continues up to total closure at the moment of time $t_8$. The transverse sealing device or mechanism 24 then remains closed up to the moment of time $t_9$, and during the time interval $t_8$ to $t_9$ the sealing of the bag or sack 28 and the separation thereof by actuating the knife 27 are accomplished. The $\Delta t$ at the beginning of the cycle corresponds with the time interval $t_9$ to $t_{10}$.

The illustrated chronological sequence may naturally experience minor changes within the teachings of the present invention. For example, prior to the point of time $t_5$ the hose or tube 18 can remain stationary for a certain time interval $t_3'$ to $t_5$, i.e. the reversing of the direction of conveyance of the hose or tube 18 can be carried out with a short standstill-pause or delay as shown in broken lines in the curve F in FIG. 3A. However, this and other smaller adjustments such as, for example, the allowance for the accelerations and decelerations of the hose or tube 18, do not change in principle the sequence of the movements as depicted in FIGS. 3A and 3B.

It is known that some foil materials have a tendency of adhering to the sealing jaws 25 and 26 after accomplishing the sealing operation. This phenomenon is interdependent with the heating of the hose or tube 18, which heating is normally required for the sealing operation.

A first possibility to improve this condition is to fabricate of poor heat-conducting material the downstream located edges 29 and 30 of the sealing jaws 25 and 26 as viewed in the "normal" or downward direction of conveyance. In this manner, the edges 29 and 30 transmit to the hose or tube 18, during the sealing operation thereof, less heat in this region located beneath the actual sealing zone, so that after separation or severance of the bag or sack 28 the same can readily free itself from the sealing jaws 25 and 26.

FIGS. 4*a* and 4*b* show a further possibility of solving the adhesion problem by using so-called stripping edges. The schematically depicted sealing jaws 25 and 26 in FIGS. 4*a* and 4*b*, such sealing jaws 25 and 26 containing in the actual case suitable heating elements and the knife or cutter 27, comprise at their lower or bottom end respective movable stripping edges 31 and 32. These stripping edges 31 and 32 are inserted in respective recesses 33 and 34 of the sealing jaws 25 and 26, respectively. Such recesses 33 and 34 serve as guides for the stripping edges 31 and 32 which are pressed against the interior of the transverse sealing device 24 by means of springs 35 and 36. As particularly clearly depicted in FIG. 4*b*, lugs or noses 37 and 38 serve as stop elements for the travel of the stripping edges 31 and 32.

Figure 2F:
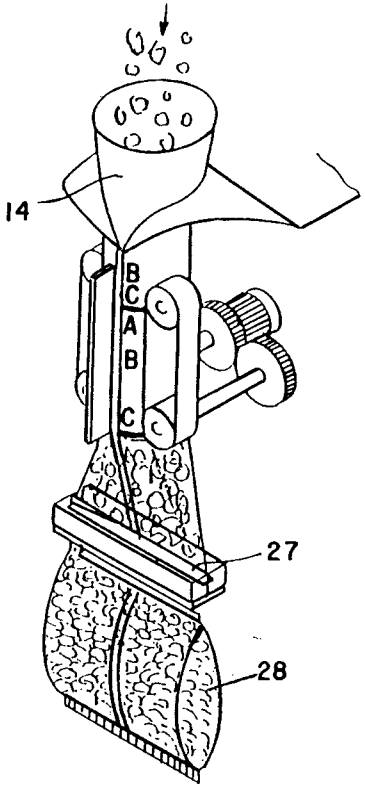
Figure 2E:
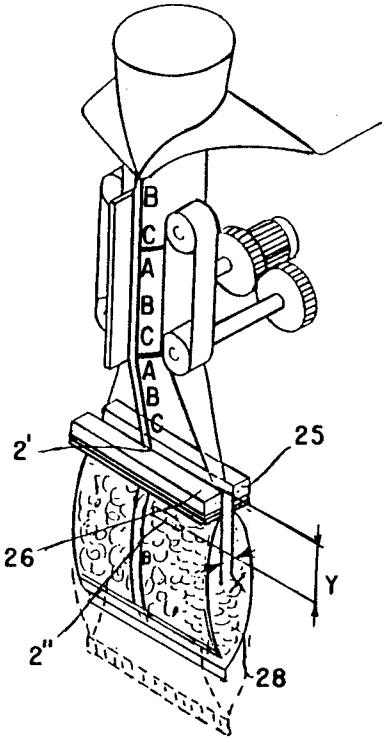

FIG. 4*a* shows the sealing jaws 25 and 26 in their fully closed condition which corresponds with the operational phase depicted in FIG. 2*f*, i.e. practically during the sealing operation. The stripping edges 31 and 32 are resiliently pressed or biased towards or against one another by the springs 35 and 36.

When the sealing jaws 25 and 26 after accomplishing the sealing operation, i.e. immediately after the condition shown in FIG. 2*f*, are opened to release the fabricated or finished bag or sack 28, the stripping edges 31 and 32 still remain in mutual contact under the action of the springs 35 and 36 until the sealing jaws 25 and 26 have so far opened that the lugs or noses 37 and 38 come to bear against the stripping edges 31 and 32.

During the discussed first phase of the opening movement of the sealing jaws 25 and 26, the stripping edges 31 and 32 press the bag or sack 28 away from the sealing jaws 25 and 26, so that the bag or sack 28 must detach itself from the latter, even when the packing foil material of the bag or sack 28 slightly adhered to the sealing jaws 25 and 26.

During the entire return or reverse motion of the hose or tube 18, the stripping edges 31 and 32 are also useful for stripping or stripping-flat the hose or tube 18. Also during this operation, in which the hose or tube 18 is displaced between the warm sealing jaws 25 and 26 which are open only up to the predetermined gap width x, there exists a certain "adhesion risk" for the hose or tube 18. In such a case, it is therefore advantageous that the gap width x is determined or defined by the cold edges of the stripping edges 31 and 32, as shown in FIG. 4*b*, and not by the warm inner surfaces 39 of the sealing jaws 25 and 26.

FIGS. 5 and 6 respectively show a top plan view of and an elevational sectional view through a suitable mechanism for the motion or travel of the transverse sealing device 24 according to the two-stage or two-step operational sequence required for the realization of the invention and in consistency with curve G in FIG. 3.

It is known to construct two-stage or two-step operating mechanisms by providing a combination of several pneumatic pistons or even more complex mechanical lever systems. Such known systems are either too inert or sluggish because, for example, pneumatic cylinders cannot be vented and filled as rapidly as required, or they are too complicated in construction and design.

The mechanism illustrated in FIGS. 5 and 6 possesses the advantages of a simple construction and design, is suitable for realizing the desired short sealing cycles and allows for rapid adjustment of the apparatus 80 in general and of the gap width x between the sealing jaws 25 and 26 in particular.

In FIG. 5 the sealing jaws are again designated with the same reference characters 25 and 26 as in FIGS. 1, 2 and 3. In the bag forming, filling and sealing apparatus 80 constructed according to the invention the sealing jaws 25 and 26 are arranged in a substantially horizontal position.

The sealing jaw 25 is firmly connected to a supporting beam 40 which, in turn, is reciprocatingly movably guided in two sleeves or bushings 43 and 44 by means of two longitudinal guides or guidances 41 and 42.

On the other hand, the sealing jaw 26 is firmly connected in the middle region or location disposed halfway between the guides 41 and 42 with a longitudinal guide or guidance 45 which likewise can reciprocatingly slide in a sleeve or bushing 46.

The longitudinal guide or guidance 41 is coupled by means of a forked link 47 to one end of a push rod 48 which at its other end is hinged at an eccentric lever 49. In similar manner, the longitudinal guides or guidances 42 and 45 are coupled by means of respective forked links 50 and 51 and via respective push rods 52 and 53 to eccentric levers 54 and 55, respectively.

The three eccentric levers 49, 54 and 55 are eccentrically seated at a common shaft 56 which is rotatably mounted by means of suitable bearing blocks 57 at a machine frame not particularly shown in the drawing.

The eccentric levers 49, 54 and 55 are practically of the same construction and design and the eccentricities of the two eccentric levers 49 and 54, which serve to accomplish the transverse motion or travel of the sealing jaw 25, are absolutely identical in order to ensure a substantially parallel motion or displacement of the sealing jaw 25. The eccentricity of the eccentric lever 55, which serves to accomplish the transverse motion or travel of the sealing jaw 26, can be different from that of the eccentric levers 49 and 54, because the length of the translatory motion or travel of the sealing jaw 26 does not have to be identical with the length of the translatory motion or travel of the sealing jaw 25. However, for reasons of symmetry it is advantageous to provide eccentric levers 49, 54 and 55 which have the same length as well as the same eccentricity. On the other hand, the eccentric levers 49 and 54 are mounted at the common shaft 56 in mirror-image eccentric manner with respect to the eccentric lever 55, so that upon rotation of the common shaft 56, the longitudinal guides or guidances 41 and 42 are moved in one direction, while the longitudinal guide or guidance 45 is moved in the opposite direction. The common shaft 56 is caused to rotate by a drive motor 58.

FIG. 6 shows a side view of the apparatus depicted in FIG. 5, the illustration thereof being a section taken substantially through the line I—I in FIG. 5. The eccentric levers 49 and 54 on the one side of the common shaft 56 and the eccentric lever 55 on the other side of the common shaft 56, at which the three eccentric levers 49, 54 and 55 are eccentrically mounted by means of suitable ball bearings 59, can pivot about respective axles or pivot pins 61 by means of rod eyes 60 of which only one is visible in FIG. 6. These axles 61 are part of respective piston shafts 62 of displacement means containing cylinder-and-piston units 63 which are hingedly secured at a stationary part of the apparatus by means of pivot bearings 64. Only one of the cylinder-and-piston units 63 is visible in FIG. 6, but it is readily conceivable that the eccentric levers 49, 54 and 55 each comprises an individual cylinder-and-piston unit 63.

The mode of operation of the device depicted in FIGS. 5 and 6 for the actuation of the transverse sealing mechanism 24 is hereinafter described and is as follows:

Upon rotation of the common shaft 56 by the drive motor 58, the eccentric levers 49, 54 and 55 pivot about their respective axles 61, whereby the eccentric levers 49 and 54 swing or pivot in the same direction and strictly in parallel relationship to each other, while the eccentric lever 55 swings or pivots in the opposite direction and practically in mirror-image fashion relative to the other two eccentric levers 49 and 54. This is particularly clearly shown in FIG. 6.

When the axles 61 are all in one line, as illustrated in FIG. 6, and the cylinder-and-piston units 63 are not moved, the axles 61 act as fixed pivot axles in space and the length of the longitudinal motion or travel of the sealing jaws 25 and 26 is solely dependent on the eccentricity of the eccentric levers 48, 54 and 55 or on the amplitude of the angle of rotation through which the common shaft 56 is rotated per work or operational cycle by the drive motor 58.

The eccentricity of the eccentric levers 48, 54 and 55 can be selected such that, by using the total eccentricity available in the eccentrics, the sealing jaws 25 and 26 approach each other up to the predetermined gap width x, this being the case in the embodiment depicted in FIG. 6. To overcome the gap width x in order to close the sealing jaws 25 and 26, i.e. displace the same into the sealing position and thus accomplish the sealing operation, the pivot axles 61 of the eccentric levers 48, 54 and 55 can be adequately moved or displaced by the cylinder-and-piston unit 63, whereby the mechanism is structured such that the closing of the sealing jaws 25 and 26 is "elastically" effected, i.e. one of the sealing jaws, for instance sealing jaw 26, bears against the other sealing jaw, in this case the sealing jaw 25, with the adjustable pressure of the pressurized medium exerted upon the associated piston of the respective cylinder-and-piston unit 63. For this purpose, no stop element in the longitudinal direction is provided for the piston of the cylinder-and-piston unit 63 of the eccentric lever 55, so that the piston can be adapted to any position of the sealing jaw 25, whereby a force, for instance the force of a return or restoring spring 65, has to be overcome.

The here described type of control of the elements of the mechanism shown in FIGS. 5 and 6 is not the only conceivable method of accomplishing the desired motion or travel of the sealing jaws 25 and 26 in accordance with the curve G depicted in FIG. 3.

A further possibility would be to use a reversible pulse-controlled dynamic motor 58 in order to achieve the same motions or movements. By suitably selecting the eccentricities of the eccentric levers 49, 54 and 55, the angles of rotation in both directions of the common shaft 56 and the standstill intervals of the drive motor 58, the same effect can be achieved. The required control elements to control such a motor 58 in the aforesaid manner and synchronized with the drive motor 21 of the draw-off belts or bands 19 and 20 are known to persons skilled in the art and therefore do not form part of the invention.

In FIG. 5, there is schematically shown the knife or cutter 27 for separating the finished or fabricated bag or sack 28. This knife 27 is inserted in the sealing jaw 25 and is actuated by means of a pneumatic cylinder-and-piston unit 66. However, it is readily conceivable that the knife 27 can also be inserted in the sealing jaw 26 and actuated by other means.

The advantages of the mechanism shown in FIGS. 5 and 6 for the movements of the sealing jaws 25 and 26 are seen in the many possibilities of adjustment, the relatively low-mass solution for the reciprocating motions of the sealing jaws 25 and 26, this allowing for high productivity speeds or rates, and the adjustment of the closing pressure between the sealing jaws 25 and 26.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for forming, filling and sealing bag-type packages, comprising:

means for infeeding a foil web from a supply roll;

a feed pipe for infeeding a product to be packed in the bag-type packages to be formed and sealed;

said feed pipe having an upper end;

a formed shoulder arranged at said upper end of said feed pipe;

said foil web being drawn over said formed shoulder to coil the foil web and form a hose having a lengthwise direction;

longitudinal sealing means for sealing said hose in said lengthwise direction;

hose conveying means for conveying said hose along said feed pipe;

transverse sealing means for sealing said hose in a transverse direction with respect to said lengthwise direction and forming the bag-type packages in predetermined package distances;

the foil web and said hose formed from the foil web having a predetermined longitudinal downstream travel direction and a predetermined longitudinal return travel direction;

said transverse sealing means being stationarily arranged with respect to travel of said hose in said predetermined longitudinal downstream and return travel directions;

said means for infeeding the foil web having drivable web entrainment means which act upon the foil web and are arranged upstream of said formed shoulder as viewed in said predetermined longitudinal downstream travel direction;

said drivable web entrainment means having drive means provided for at least return travel of the foil web in said predetermined longitudinal return travel direction;

said hose conveying means having drivable hose entrainment means which act upon said hose;

said drivable hose entrainment means having reversible drive means for selective movement of said hose in said predetermined longitudinal downstream travel direction and in said predetermined longitudinal return travel direction;

said transverse sealing means containing at least two sealing jaws operating in two stages;

said transverse sealing means further containing moving means for transversely moving said at least two sealing jaws relative to each other as well as relative to said hose;

said moving means containing:

at least two eccentric levers having two ends and being respectively connected at one of their two ends with said at least two sealing jaws;

at least two axles for respectively pivotally mounting said at least two eccentric levers at an other one of their two ends;

a common shaft at which said at least two eccentric levers are mounted at a predetermined location between their two ends;

additional drive means for reversibly rotating said common shaft about its axis in order to thereby reversibly move said at least two eccentric levers transversely relative to each other as well as relative to said hose;

said additional drive means reversibly moving said at least two sealing jaws in a first stage to form in said hose a transversely disposed constrictive location which narrows up to a predetermined gap width; and said additional drive means moving said at least two sealing jaws in a second stage to close said at least two sealing jaws in order to from a transverse sealing seam.

2. The apparatus as defined in claim 1, wherein:

said at least two sealing jaws comprise edges at a downstream side thereof as viewed in said predetermined longitudinal downstream travel direction; and said edges of said at least two sealing jaws being formed of poor heat-conducting material.

3. The apparatus as defined in claim 1, wherein:

said transverse sealing means are provided with stripping means which are located downstream of said at least two sealing jaws of said sealing mechanism as viewed in said predetermined downstream travel direction;

spring means supporting said stripping means at said at least two sealing jaws such that, during said first stage of operation of said at least two sealing jaws of said sealing mechanism to form said transversely disposed constrictive location in said hose, said spring means move said stripping means up to said predetermined gap width while said at least two sealing jaws are located at a larger mutual spacing; and said hose during travel thereof in said predetermined longitudinal return travel direction through said constrictive location being stripped and kept at a distance from said at least two sealing jaws which are heated to form said transverse sealing seam during said second stage of operation of said sealing mechanism.

4. The apparatus as defined in claim 1, wherein:

said drivable web entrainment means comprises an entrainment roll;

said drive means for said entrainment roll comprising a motor for providing said return travel of the foil web in said predetermined longitudinal return travel direction; and said entrainment roll being freely co-rotated during infeeding of the foil web in said predetermined longitudinal downstream travel direction.

5. The apparatus as defined in claim 1, wherein:

said drivable web entrainment means comprises an entrainment roll;

said drive means for said entrainment roll comprising a motor for providing said return travel of the foil web in said predetermined longitudinal return travel direction; and said entrainment roll being at most slightly co-rotationally braked during infeeding of the foil web in said predetermined longitudinal downstream travel direction.

6. The apparatus as defined in claim 1, wherein:

said drivable hose entrainment means comprises two drive belts arranged at said feed pipe; and said reversible drive means for said two drive belts comprising a reversing motor which is reversible in rotational direction and provides forward feed of said hose in said predetermined longitudinal downstream travel direction as well as return feed of said hose in said predetermined longitudinal return travel direction.

7. The apparatus as defined in claim 1, wherein said additional drive means contain a first pulse-controlled and reversible dynamic motor for reversibly rotating said common shaft; and said two stages of operation of said at least two sealing jaws being adjustable in their chronological sequence as well as in their amplitude by setting the amplitude of the rotational movements and the direction of rotation of said common shaft.

8. The apparatus as defined in claim 1, wherein said additional drive means contain a reversible dynamic motor for reversibly rotating said common shaft; and said two stages of operation of said at least two sealing jaws being adjustable in their chronological sequence as well as in their amplitude by setting the direction of rotation of said common shaft.

9. The apparatus as defined in claim 1, wherein said additional drive means contain at least two displacement means respectively connected to said at least two axles; and said at least two displacement means serving to respectively reversibly displace said at least two axles and thereby said at least two sealing jaws between said first stage and said second stage.

10. The apparatus as defined in claim 8, wherein:

said additional drive means contain at least two displacement means respectively connected to said at least two axles; and said displacement means serving to respectively reversibly displace said at least two axles and thereby said at least two sealing jaws between said first stage and said second stage.

11. The apparatus as defined in claim 7, further including:

a control unit;

said drive means of said drivable web entrainment means comprises a second pulse-controlled and reversible dynamic motor;

said reversible drive means of said drivable hose entrainment means comprises a third pulse-controlled and reversible dynamic motor;

said first, second and third pulse-controlled and reversible dynamic motors being controlled by said control unit such that forward feed and return feed of said hose and said foil web and said two stages of operation of said at least two sealing jaws are selectable in accordance with a predetermined sequence in time as well as spatial motion and synchronizable to one another.

12. An apparatus for forming, filling and sealing bag-type packages, comprising:

means for infeeding a foil web from a supply;

a stationary feed pipe for infeeding a product to be packed in the bag-type packages to be formed and sealed;

a stationary formed shoulder;

said foil web being drawn over said stationary formed shoulder to coil the foil web at said stationary feed pipe and form a hose having a lengthwise direction;

longitudinal sealing means for sealing said hose in said lengthwise direction;

transverse sealing means for sealing said hose in a transverse direction with respect to said lengthwise direction and forming the bag-type packages in predetermined package distances;

the foil web and said hose formed from the foil web having a predetermined longitudinal downstream travel direction and a predetermined longitudinal return travel direction;

said means for infeeding the foil web having drivable web entrainment means which act upon the foil web and are arranged upstream of said formed shoulder as viewed in said predetermined longitudinal downstream travel direction;

said drivable web entrainment means having drive means provided for at least return travel of the foil web in said predetermined longitudinal return travel direction;

drivable hose entrainment means which act upon said hose;

said drivable hose entrainment means having reversible drive means for selective movement of said hose in said predetermined longitudinal downstream travel direction and in said predetermined longitudinal return travel direction;

said movement of said hose being effected by said drivable hose entrainment means without comovement of associated parts of the apparatus;

said transverse sealing means being stationarily arranged with respect to travel of said hose in said predetermined longitudinal downstream and return travel conditions;

said transverse sealing means containing at least two sealing jaws and stripping means coupled to said at least two sealing jaws and located downstream thereof as viewed in said predetermined longitudinal travel direction of said hose;

said transverse sealing means further containing moving means for transversely moving said at least two sealing jaws and conjointly therewith said stripping means relative to each other and relative to said hose;

said moving means containing:

at least two eccentric levers having two ends and being connected at one of their two ends with said at least two sealing jaws;

at least two axles for respectively pivotally mounting said at least two eccentric levers at an other one of their two ends;

a common shaft at which said at least two eccentric levers are mounted at a predetermined location between their two ends;

additional drive means for reversibly rotating said common shaft about its axis in order to thereby reversibly move said at least two sealing jaws transversely relative to said hose between an open position and a stripping position;

at least two displacement means for respectively reversibly displacing said at least two axles in order to thereby respectively reversibly pivot said at least two eccentric levers and thereby reversibly displace said at least two sealing jaws transversely relative to said hose between said stripping and a sealing position;

said stripping means containing at least two stripping edges and respective spring means coupling said at least two stripping edges to respective ones of said at least two sealing jaws;

said spring means biasing said at least two stripping edges into engagement with said hose in order to form in said hose a transversely disposed constrictive location having a predetermined gap width in the stripping position of said at least two sealing jaws; and a control unit controlling the operation of said web entrainment means, said hose entrainment means and said transverse sealing means in timewise coordinating fashion.

* * * * *